US007588428B2

(12) United States Patent
Masuda

(10) Patent No.: US 7,588,428 B2
(45) Date of Patent: Sep. 15, 2009

(54) ROTARY FLUID DEVICE PERFORMING COMPRESSION AND EXPANSION OF FLUID WITHIN A COMMON CYLINDER

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/572,923

(22) PCT Filed: May 11, 2005

(86) PCT No.: PCT/JP2005/008634

§ 371 (c)(1),
(2), (4) Date: Mar. 21, 2006

(87) PCT Pub. No.: WO2005/108794

PCT Pub. Date: Nov. 17, 2005

(65) Prior Publication Data

US 2007/0003425 A1 Jan. 4, 2007

(30) Foreign Application Priority Data

May 11, 2004 (JP) ..... 2004-140692

(51) Int. Cl.
*F03C 2/00* (2006.01)
*F04C 18/00* (2006.01)
*F04C 2/00* (2006.01)

(52) U.S. Cl. ..... 418/59

(58) Field of Classification Search ..... 418/58, 418/59, 209, 249
See application file for complete search history.

(56) References Cited

U.S. PATENT DOCUMENTS 141,226 A * 7/1873 Jenkins ..... 418/59
1,229,676 A * 6/1917 Tice ..... 418/59
1,906,142 A * 4/1933 Ekelof ..... 418/59
RE24,500 E * 7/1958 Straatveit ..... 418/59
5,302,095 A * 4/1994 Richardson, Jr. ..... 418/59
5,950,452 A 9/1999 Sakitani et al.

FOREIGN PATENT DOCUMENTS

| | | | |
|---|---|---|---|
| CN | 1353286 | A | 6/2002 |
| JP | 52-98845 | A | 8/1977 |
| JP | 56-020703 | A | 2/1981 |
| JP | 59-041602 | A | 3/1984 |
| JP | 61-73001 | U | 5/1986 |
| JP | 63-140831 | A | 6/1988 |
| JP | 2003-138901 | A | 5/2003 |
| KR | 100118462 | B1 | 7/1997 |
| KR | 10-0372043 | | 6/2003 |
| WO | WO-02-088529 | A1 | 11/2002 |

* cited by examiner

*Primary Examiner*—Theresa Trieu
(74) *Attorney, Agent, or Firm*—Global IP Counselors

(57) ABSTRACT

A rotary fluid device includes a cylinder having an annular cylinder chamber and an annular piston, which is disposed in the cylinder chamber to be eccentric relative to the cylinder. The annular piston divides the cylinder chamber into an outer working chamber and an inner working chamber. A blade is disposed in the cylinder chamber to partition each of the working chambers into a high-pressure space and a low-pressure space. The cylinder and the piston relatively rotate. The outer working chamber constitutes a compression chamber which compresses and discharges a sucked fluid with the progress of the relative rotation of the cylinder and the piston. The inner working chamber constitutes an expansion chamber which expands and discharges a sucked fluid with the progress of the relative rotation of the cylinder and the piston.

3 Claims, 4 Drawing Sheets

ROTARY FLUID DEVICE PERFORMING COMPRESSION AND EXPANSION OF FLUID WITHIN A COMMON CYLINDER

CROSS-REFERENCE TO RELATED APPLICATIONS

This U.S. National stage application claims priority under 35 U.S.C. §119(a) to Japanese Patent Application No. 2004-140692, filed in Japan on May 11, 2004, the entire contents of which are hereby incorporated herein by reference.

TECHNICAL FIELD

The present invention relates to a rotary fluid device and specifically to a rotary fluid device having a compression chamber and an expansion chamber.

BACKGROUND ART

Conventionally, there has been a fluid device including a compression mechanism and an expansion mechanism as disclosed in Japanese Laid Open Patent Publication No. 2003-138901. The fluid device has a rotary compressor accommodated in the lower part of the casing and a scrollable expander accommodated in the upper part of the casing. The fluid device also includes an electric motor between the compressor and the expander. The compressor and expander are coupled to both ends of a drive shaft which is connected to the motor.

The compressor compresses a refrigerant. The compressed refrigerant discharges heat in a heat exchanger and is then expanded by the expander. The expanded refrigerant absorbs heat in another heat exchanger and returns to the compressor. This cycle is repeated. In the expander, rotational power generated by the expansion of the refrigerant is recovered. The recovered rotational power and the rotational power of the electric motor drive the compressor. As a result, efficient driving is realized.

SUMMARY OF THE INVENTION

However, in the conventional fluid device, the compressor and the expander are placed on different planes. Therefore, the overall size of the device is large, and the number of parts is also large. Specifically, the compressor is placed in the lower part of the casing while the expander is placed in the upper part of the casing, and this arrangement increases the overall vertical dimension of the device. Further, the compressor and the expander are completely separate from each other so as not to have any common part, and therefore, the overall device has a large number of parts.

The present invention was conceived in view of the above problems. Objectives of the present invention are reducing the number of parts and decreasing the overall dimensions of the device.

As shown in FIG. 1, a rotary fluid device pertaining to a first aspect of the present invention comprises a rotation mechanism (20). The rotation mechanism (20) includes: a cylinder (21) having an annular cylinder chamber (50); an annular piston (22) which is accommodated in the cylinder chamber (50) to be eccentric relative to the cylinder (21), the annular piston (22) dividing the cylinder chamber (50) into an outer working chamber (51) and an inner working chamber (52); and a blade (23) placed in the cylinder chamber (50) and partitioning each of the working chambers (51, 52) into a high-pressure space and a low-pressure space, the cylinder (21) and the piston (22) being relatively rotatable. One of the two working chambers (51, 52) constitutes a compression chamber which compresses and discharges a sucked fluid with the progress of the relative rotation of the cylinder (21) and the piston (22). The other of the two working chambers (51, 52) constitutes an expansion chamber which expands and discharges a sucked fluid with the progress of the relative rotation of the cylinder (21) and the piston (22).

In the first aspect of the present invention, as the rotation mechanism (20) is driven, the cylinder (21) and the piston (22) relatively rotate, so that the volume of the compression chamber (51) decreases to compress the fluid, while the volume of the expansion chamber (52) increases to expand the fluid. The expansion of the fluid allows recovery of power.

The rotary fluid device according to a second aspect of the present invention is the rotary fluid device of the first aspect of the present invention further comprising a suction mechanism (60) that allows the refrigerant to be introduced into the expansion chamber (52) in a predetermined rotation angle range of the piston (22) such that an expansion process of the fluid in the expansion chamber (52) occurs in a predetermined range within one rotation cycle of the piston (22) relative to the cylinder (21).

In the second aspect of the present invention, the fluid is introduced into the expansion chamber (52) by the suction mechanism (60) within a predetermined rotation angle range of the piston (22). As a result, the expansion process of the fluid in the expansion chamber (52) occurs in a predetermined range within one rotation cycle of the piston (22) relative to the cylinder (21), such that the pressure and expansion work of the fluid are recovered.

The rotary fluid device according to a third aspect of the present inventions is the rotary fluid device of the first aspect of the present invention, wherein the compression chamber (51) is a working chamber formed outside the cylinder chamber (50), and the expansion chamber (52) is a working chamber formed inside the cylinder chamber (50).

In the third aspect of the present invention, the compression chamber (51) is formed outside the cylinder chamber (50) while the expansion chamber (52) is formed inside the cylinder chamber (50). Therefore, a predetermined compression capacity is achieved.

The rotary fluid device according to a fourth aspect of the present invention is the rotary fluid device of the first aspect of the present invention, further comprising a drive mechanism (30) for driving the rotation mechanism (20). The rotation speed of the drive mechanism (30) is variably controlled.

In the fourth aspect of the present invention, the rotation of the drive mechanism (30) is controlled. Therefore, the operation is carried out according to required performance such that the efficiency is further improved.

The rotary fluid device according to a fifth aspect of the present invention is the rotary fluid device of the first aspect of the present invention, wherein the piston (22) has the shape of C formed by removing a part of its annular structure to make a slit. The blade (23) extends between an inner peripheral wall surface and an outer peripheral wall surface of the cylinder chamber (50) through the slit of the piston (22). A swing bush (27) is provided in the slit of the piston (22) so as to be in surface contact with the piston (22) and the blade (23) such that the blade (23) is reciprocatable and swingable relative to the piston (22).

In the fifth aspect of the present invention, the blade (23) reciprocates in the swing bush (27) while the blade (23) and the swing bush (27) integrally swing relative to the piston (22). With this structure, the cylinder (21) and the piston (22)

rotate while relatively swinging such that the rotation mechanism (20) performs predetermined compression and expansion operations.

According to the second aspect of the present invention, since introduction of the refrigerant into the expansion chamber (52) is limited only to a predetermined rotation angle, even expansion work can also be recovered. Therefore, the efficiency is further improved.

According to the third aspect of the present invention, since the compression chamber (51) is formed outside the cylinder chamber (50) and the expansion chamber (52) is formed inside the cylinder chamber (50), the compression capacity is fully utilized.

According to the fourth aspect of the present invention, since the rotation of the drive mechanism (30) is controlled, the operation efficiency is further improved.

According to the fifth aspect of the present invention, the swing bush (27) is provided as a coupling member for coupling the piston (22) and the blade (23) and is configured to be substantially in surface contact with the piston (22) and the blade (23). This arrangement avoids the wearing-away of the piston (22) and the blade (23) and the burning of the contact portions therebetween during operation.

According to the present invention, the compression chamber (51) and the expansion chamber (52) are formed outside and inside the piston (22), respectively. Therefore, the overall size of the device is decreased.

Since the compression chamber (51) and the expansion chamber (52) are located adjacent to each other on the same plane, some components can be shared therebetween, resulting in a decrease in the number of components.

According to the second aspect of the present invention, since introduction of the refrigerant into the expansion chamber (52) is limited to a predetermined rotation angle, even expansion work can also e recovered. Therefore, the efficiency is further improved.

According to the third aspect of the present invention, since the compression chamber (51) is formed outside the cylinder chamber (50) and the expansion chamber (52) is formed inside the cylinder chamber (50), the compression capacity is fully utilized.

According to the fourth aspect of the present invention, since the rotation of the drive mechanism (30) is controlled, the operation efficiency is further improved.

According to the fifth aspect of the present invention, the swing bush (27) is provided as a coupling member for coupling the piston (22) and the blade (23) and is configured to be substantially in surface contact with the piston (22) and the blade (23). This arrangement avoids the wearing-away of the piston (22) and the blade (23) and the burning of the contact portions therebetween during operation.

Since the swing bush (27) is provided to be in surface contact with the piston (22) and the blade (23), the contact portions achieves excellent sealing characteristics. Therefore, leakage of a refrigerant from the compression chamber (51) and the expansion chamber (52) is surely prevented, and decreases in the compression efficiency and expansion efficiency are also prevented.

Since the blade (23) is integrally provided to the cylinder (21) and supported at both ends by the cylinder (21), it is less likely to apply an abnormal concentrated load to the blade (23) and cause stress concentration during operation. Thus, the slidable portion is more resistant to damage. This feature also improves the reliability of the mechanism.

DETAILED DESCRIPTION OF THE INVENTION

Hereinafter, embodiments of the present invention will be described in detail with reference to the drawings.

EMBODIMENT 1

Figure 1:
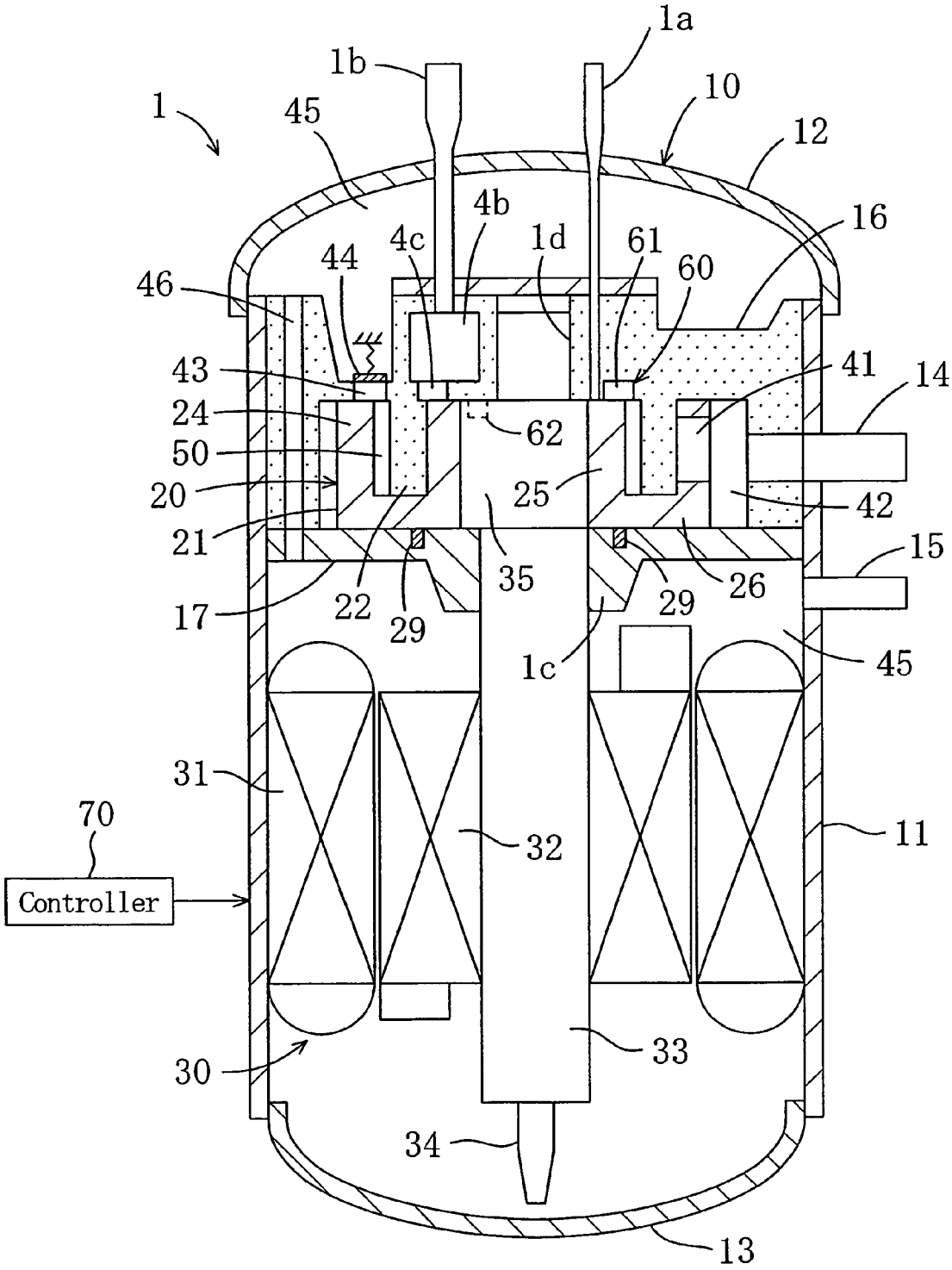
FIG. 1 is a vertical cross-sectional view of an expansion/compression unit according to an embodiment of the present invention.
Figure 2:
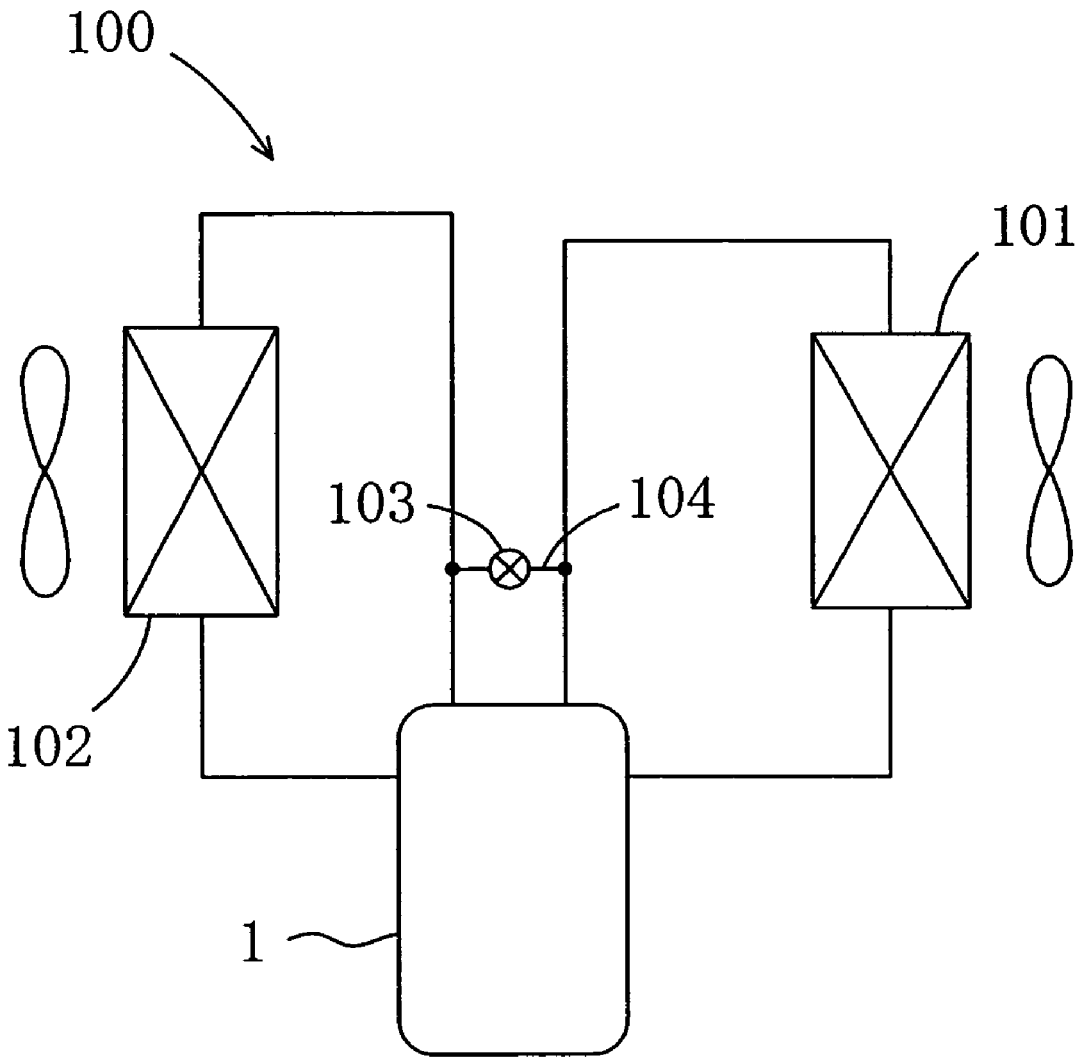
FIG. 2 is a circuit diagram showing a refrigerant circuit which has an expansion/compression unit.
Figure 3:
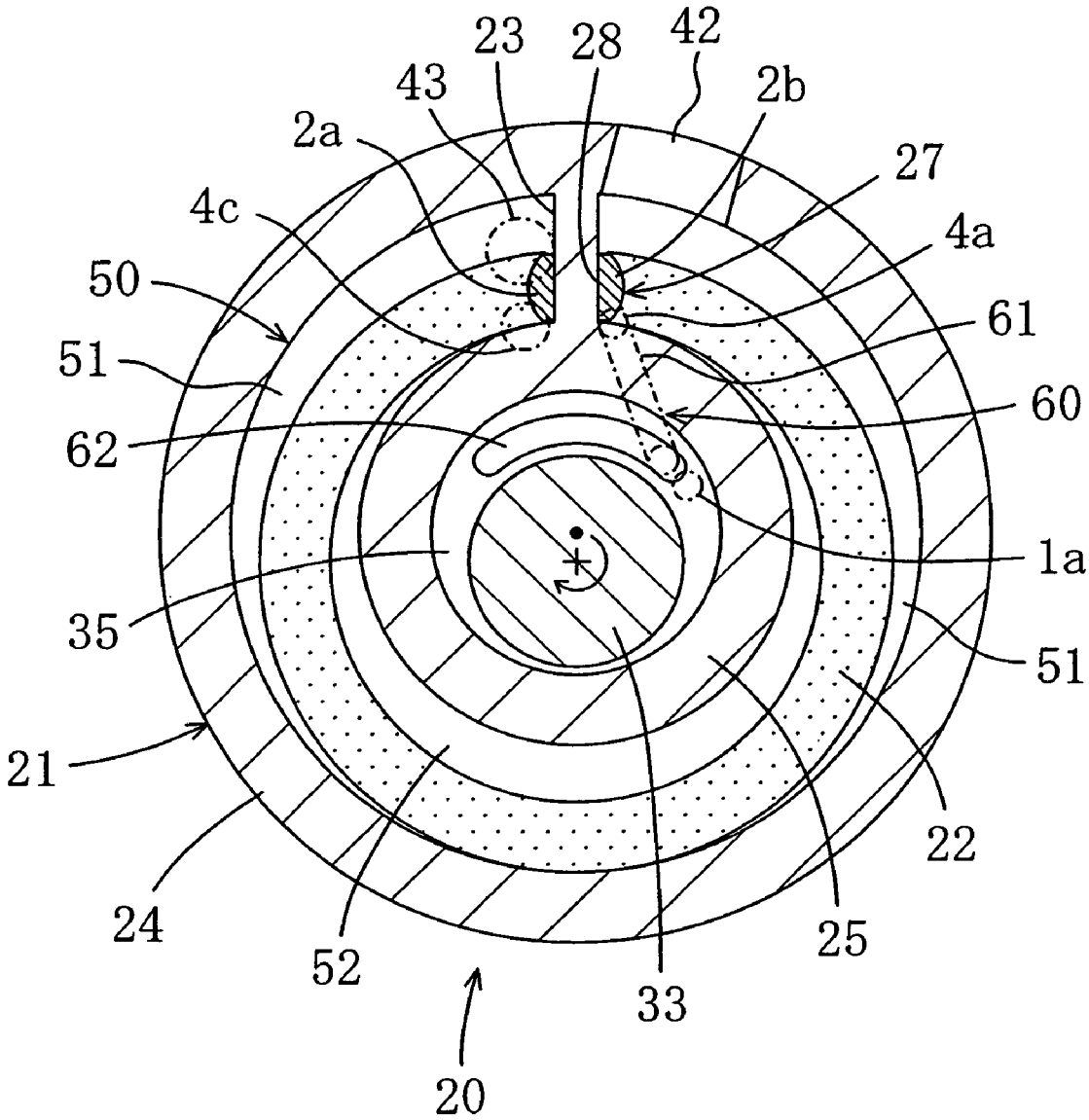
FIG. 3 is a horizontal cross-sectional view of an expansion/compression mechanism.

Referring to FIG. 1 to FIG. 3, this embodiment is an application of the present invention to an expansion/compression unit (1) which is a compressor including an expander. The expansion/compression unit (1) is included in a refrigerant circuit (100).

The refrigerant circuit (100) uses, for example, carbon dioxide (C02) as a refrigerant and is configured to perform at least any of a cooling operation and a heating operation by compressing $CO_2$ over the critical pressure. The refrigerant circuit (100) includes, as shown in FIG. 2, an exterior heat exchanger (101) serving as a heat source-side heat exchanger and an interior heat exchanger (102) serving as a use-side heat exchanger, which are connected to the expansion/compression unit (1). For example, the refrigerant compressed by the expansion/compression unit (1) discharges heat in the exterior heat exchanger (101) and is then expanded by the expansion/compression unit (1). The expanded refrigerant absorbs heat in the interior heat exchanger (102) and returns to the expansion/compression unit (1). This cycle is repeated, whereby indoor air is cooled by the interior heat exchanger (102). The refrigerant circuit (100) further includes a bypass passage (104) having an expansion mechanism (103), such as an expansion valve, or the like, such that the mass flow rate of the refrigerant in a compression chamber (51), which will be described later, and the mass flow rate of the refrigerant in an expansion chamber (52) are in harmony with each other. Specifically, part of the refrigerant which has discharged heat in the exterior heat exchanger (101) flows through the bypass passage (104), thereby bypassing the expansion/compression unit (1) to flow into the interior heat exchanger (102).

The expansion/compression unit (1) is a completely hermetic rotary fluid device wherein an expansion/compression mechanism (20) and an electric motor (30) are contained in a casing (10).

The casing (10) includes a cylindrical barrel (11), a top end plate (12) fixed to the top end of the barrel (11), and a bottom end plate (13) fixed to the bottom end of the barrel (11). The barrel (11) has a suction pipe (14) and discharge pipe (15) penetrating through the barrel (11). The suction pipe (14) is connected to the interior heat exchanger (102), while the discharge pipe (15) is connected to the exterior heat exchanger (101). The top end plate (12) has an inlet pipe (1*a*) and an outlet pipe (1*b*) penetrating through the top end plate (12). The inlet pipe (1*a*) is connected to the exterior heat exchanger (101), while the outlet pipe (1*b*) is connected to the interior heat exchanger (102).

The expansion/compression mechanism (20) constitutes a rotational mechanism as shown in FIG. 3 and is configured to carry out compression and expansion of refrigerant on the same plane at the same time. The expansion/compression mechanism (20) is provided between an upper housing (16) and a lower housing (17) which are fixed to the casing (10). The expansion/compression mechanism (20) includes a cylinder (21) having an annular cylinder chamber (50), an annular piston (22) which is contained in the cylinder chamber (50) and which divides the cylinder chamber (50) into a compression chamber (51) and an expansion chamber (52), and a blade (23) which divides each of the compression chamber (51) and the expansion chamber (52) into a high pressure space and a low pressure space as shown in FIG. 3. The piston (22) in the cylinder chamber (50) is configured to make eccentric revolutions relative to the cylinder (21). Specifically, relative eccentric rotation is made between the piston (22) and the cylinder (21). In embodiment 1, the cylinder (21) having the cylinder chamber (50) is movable, while the piston (22) contained in the cylinder chamber (50) is stationary.

The electric motor (30) includes a stator (31) and a rotor (32) to constitute a driving mechanism. The stator (31) is placed below the expansion/compression mechanism (20) and fixed to the barrel (11) of the casing (10). A drive shaft (33) is coupled to the rotor (32) such that the drive shaft (33) rotates together with the rotor (32). The drive shaft (33) vertically penetrates through the cylinder chamber (50).

The drive shaft (33) is provided with an oil-supply passage (not shown) extending axially within the drive shaft (33). An oil-supply pump (34) is provided at the lower end of the drive shaft (33). The oil-supply passage extends upwardly from the oil-supply pump (34). Lubricating oil accumulated in the bottom of the casing (10) is supplied to slidable part of the compression mechanism (20) through the oil-supply passage by the oil-supply pump (34).

Part of the drive shaft (33) which is contained in the cylinder chamber (50) is eccentric part (35). The eccentric part (35) has a larger diameter than the other parts of the drive shaft (33) above and below the eccentric part (35) and is eccentric from the axial center of the drive shaft (33) by a predetermined amount.

The cylinder (21) includes an outer cylinder (24) and an inner cylinder (25). The outer cylinder (24) and the inner cylinder (25) are integrally coupled at their lower ends by an end plate (26) to each other. The inner cylinder (25) is slidably fitted to the eccentric part (35) of the drive shaft (33).

The piston (22) is formed integrally with the upper housing (16). The upper housing (16) and the lower housing (17) have bearings (1*c*, 1*d*) for supporting the drive shaft (33). Thus, the expansion/compression unit (1) of this embodiment takes on a through-axis structure wherein the drive shaft (33) vertically penetrates through the cylinder chamber (50) and parts of the drive shaft (33) on both axial sides of the eccentric part (35) are supported by the bearings (1*c*, 1*d*) in the casing (10).

The expansion/compression mechanism (20) includes a swing bush (27) through which the piston (22) and the blade (23) are movably coupled to each other. The piston (22) has the shape of C formed by removing a part of an annular structure to make a slit. The blade (23) extends between an inner peripheral wall surface and an outer peripheral wall surface of the cylinder chamber (50) through the slit of the piston (22) in a radial direction of the cylinder chamber (50) and is fixed to the outer cylinder (24) and the inner cylinder (25). The swing bush (27) constitutes, at the slit of the piston (22), a coupling member for coupling the piston (22) and the blade (23).

The inner peripheral surface of the outer cylinder (24) and the outer peripheral surface of the inner cylinder (25) represent concentrically disposed cylindrical surfaces, between which a single cylinder chamber (50) is formed. The outer peripheral surface of the piston (22) has a smaller diameter than the inner peripheral surface of the outer cylinder (24), and the inner peripheral surface of the piston (22) has a larger diameter than the outer peripheral surface of the inner cylinder (25). Thus, a compression chamber (51) serving as a working chamber is between the outer peripheral surface of the piston (22) and the inner peripheral surface of the outer cylinder (24), and an expansion chamber (52) serving as a working chamber is between the inner peripheral surface of the piston (22) and the outer peripheral surface of the inner cylinder (25).

The piston (22) and the cylinder (21) are configured as follows: when the outer peripheral surface of the piston (22) substantially makes contact with the inner peripheral surface of the outer cylinder (24) at one point (strictly, there is a gap on the order of microns but no significant leak of a refrigerant from the gap), the inner peripheral surface of the piston (22) substantially makes contact with the outer peripheral surface of the inner cylinder (25) at one point which is different in phase by 180 degrees from the contact point between the outer peripheral surface of the piston (22) and the inner peripheral surface of the outer cylinder (24).

The swing bush (27) is formed by a discharge-side bush (2*a*) on the discharge side relative to the blade (23) and a suction-side bush (2*b*) on the suction side relative to the blade (23). The discharge-side bush (2*a*) and the suction-side bush (2*b*) are formed in the same shape to both have generally semicircular cross sections and disposed to have their flat surfaces opposed to each other. The space between the opposed surfaces of the discharge-side bush (2*a*) and suction-side bush (2*b*) forms a blade groove (28).

The blade (23) is inserted into the blade groove (28). The flat surfaces of the swing bush (27) are substantially in surface contact with the blade (23), and arc-shaped outer peripheral surfaces of the swing bush (27) are substantially in surface contact with the piston (22). The swing bush (27) is configured such that the blade (23) reciprocates within the blade groove (28) along the surfaces of the blade (23) with the blade (23) caught in the blade groove (28). The swing bush (27) is also configured to swing integrally with the blade (23) relative to the piston (22). In other words, the swing bush (27) is configured such that the blade (23) and the piston (22) are swingable relative to each other with the central point of the swing bush (27) being the swing center, and the blade (23) is reciprocatable relative to the piston (22) along the surfaces of the blade (23).

Although in the example described in this embodiment the discharge-side bush (2*a*) and the suction-side bush (2*b*) are independent of each other, both of the buses (2*a*, 2*b*) may be partly coupled to each other so as to form an integral structure.

With the above structure, the rotation of the drive shaft (33) allows the outer cylinder (24) and the inner cylinder (25) to swing with the central point of the swing bush (27) being the swing center while the blade (23) reciprocates in the blade groove (28). This swing action allows the contact points between the piston (22) and the cylinder (21) to move sequentially from (A) through (D) in FIG. 4. In this sequence, the outer cylinder (24) and the inner cylinder (25) revolve around the drive shaft (33) but do not rotate.

Furthermore, the volume of the compression chamber (51) outside the piston (22) is reduced in the order of (C), (D), (A) and (B) as shown in FIG. 4. The volume of the expansion chamber (52) inside the piston (22) is reduced in the order of (A), (B), (C) and (D) as shown in FIG. 4.

The upper housing (16) has a suction space (41) at a position on the outer periphery of the outer cylinder (24). The suction pipe (14) is connected to the suction space (41). The outer cylinder (24) has a suction port (42). The suction port (42) allows communication between the compression chamber (51) and the suction space (41). The suction port (42) is provided in the vicinity of the blade (23), for example, on the right side of the blade (23) in FIG. 3.

The upper housing (16) has a discharge port (43). The discharge port (43) penetrates the upper housing (16) in its axial direction. The lower end of the discharge port (43) is open to the high pressure space of the compression chamber (51). Specifically, the discharge port (43) is formed near the blade (23) and positioned opposite to the suction port (42) relative to the blade (23). The upper end of the discharge port (43) communicates with a discharge space (45) through a discharge valve (44) which is a reed valve for opening/closing the discharge port (43).

The discharge space (45) is provided above the upper housing (16) and under the lower housing (17). The discharge space (45) provided above the upper housing (16) and the discharge space (45) provided under the lower housing (17) communicate with each other through a discharge path (46). The discharge space (45) communicates with the discharge pipe (15).

The inlet pipe (1*a*) penetrates through the upper housing (16) to have an opening in the lower surface of the upper housing (16). The opening of the inlet pipe (1*a*) faces the upper surface of the inner cylinder (25) and the upper surface of the eccentric part (35) of the drive shaft (33). The opening of the inlet pipe (1*a*) is closed by the inner cylinder (25) or the eccentric part (35) of the drive shaft (33).

A suction mechanism (60) is formed in the lower surface of the upper housing (16) and the upper surface of the eccentric part (35) of the drive shaft (33). The suction mechanism (60) allows the refrigerant to be introduced into the expansion chamber (52) in a predetermined rotation angle range of the piston (22) such that a refrigerant expansion process in the expansion chamber (52) occurs in a predetermined range within one rotation cycle of the piston (22) relative to the cylinder (21). Specifically, the suction mechanism (60) is formed by two paths, a first path (61) and a second path (62).

The first path (61) is formed by a groove having a U-shaped cross section in the lower surface of the upper housing (16). One end of the first path (61) has an opening in the vicinity of the blade (23) on the side closer to the suction port (42). When the piston (22) rotates from the bottom dead point (the state shown in FIG. 4(A)), the one end of the first path (61) is on an inlet port (4*a*) formed in the expansion chamber (52). The first path (61) extends in the axial direction of the drive shaft (33). The other end has an opening in the vicinity of the inlet pipe (1*a*).

The second path (62) is formed by a groove having a U-shaped cross section in the upper surface of the eccentric part (35) of the drive shaft (33). The second path (62) has the shape of an arc defined around the shaft center of the drive shaft (33) so as to allow communication between the first path (61) and the inlet pipe (1*a*) in a predetermined rotation angle range. Specifically, the second path (62) allows communication between the first path (61) and the inlet pipe (1*a*) during a period when the piston (22) rotates 90° from the bottom dead point (during a period when the state changes from FIG. 4(A) to FIG. 4(B)) such that the refrigerant flows into the expansion chamber (52).

The upper housing (16) includes a low-pressure chamber (4*b*). The low-pressure chamber (4*b*) has an outlet port (4*c*) and communicates with the outlet pipe (1*b*). The outlet port (4*c*) is provided at a position in the vicinity of the blade (23), which is opposite to the one end of the first path (61), but on the same side with the discharge port (43), relative to the blade (23), and opens on the expansion chamber (52).

A seal ring (29) is disposed in the lower housing (17). The seal ring (29) is inserted into an annular groove of the lower housing (17) and pressed against the lower surface of the end plate (26) of the cylinder (21). Furthermore, high-pressure lubricating oil is introduced into the interface (contact surface) between the cylinder (21) and the lower housing (17) only radially inside the seal ring (29). In the above structure, the seal ring (29) constitutes a compliance mechanism for adjusting the axial location of the cylinder (21), such that axial gaps among the piston (22), the cylinder (21) and the upper housing (16) are reduced.

The rotation speed of the electric motor (30) is controlled by a controller (70) having a control circuit, such as an inverter, or the like.

—Running Operation—

Next, a running operation of the expansion/compression unit (1) is described.

When the electric motor (30) is started, the rotation of the rotor (32) is transferred to the outer cylinder (24) and inner cylinder (25) of the expansion/compression mechanism (20) via the drive shaft (33). Then, the blade (23) reciprocates (moves forth and back) through the swing bush (27), while the blade (23) and the swing bushing (27) integrally swing relative to the piston (22). As a result, the outer cylinder (24) and inner cylinder (25) revolve while swinging relative to the piston (22), whereby the expansion/compression mechanism (20) performs predetermined compression and expansion operations.

Figure 4A:
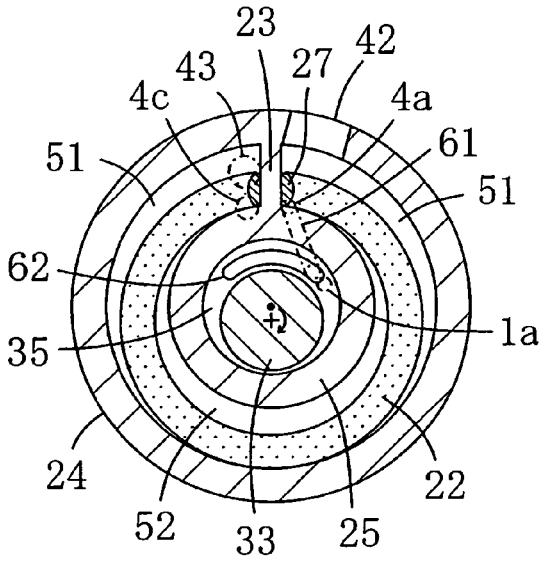
FIG. 4 shows horizontal cross-sectional views which illustrate an operation of an expansion/compression mechanism.
Figure 4D:
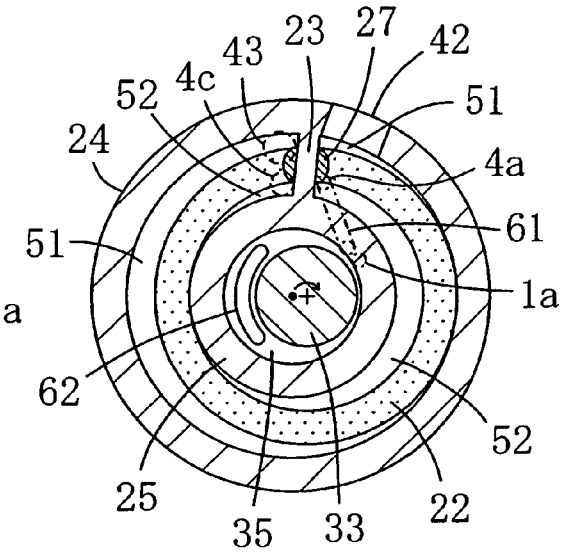
Figure 4B:
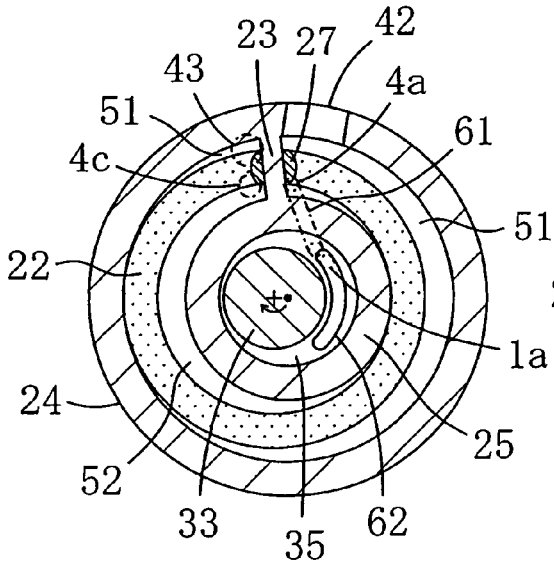
Figure 4C:
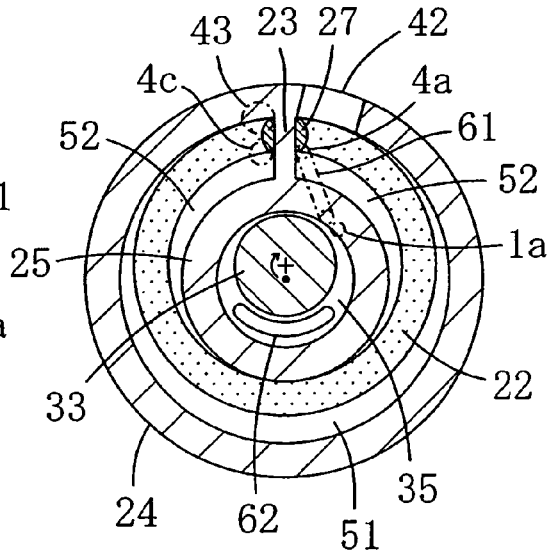

Specifically, when the piston (22) is at the top dead center as shown in FIG. 4(C) and then the drive shaft (33) rotates clockwise, the suction process is started. Subsequently, the structure transitions sequentially in the order of (D), (A) and (B) of FIG. 4, so that the volume of the compression chamber (51) increases and the refrigerant is introduced through the suction port (42).

When the piston (22) is at the top dead center as shown in FIG. 4(C), the compression chamber (51) forms a single compression chamber outside the piston (22). In this state, the volume of the compression chamber (51) is substantially the maximum. Then, as the drive shaft (33) rotates clockwise to change the structure in the order of (D), (A) and (B) of FIG. 4, the volume of the compression chamber (51) decreases so that the refrigerant is compressed. When the pressure in the compression chamber (51) reaches a predetermined value and the pressure difference between the compression chamber (51) and the discharge space (45) reaches a set value, the discharge valve (44) is opened by the high-pressure refrigerant of the compression chamber (51), so that the high-pressure refrigerant is released from the discharge space (45) through the discharge pipe (15).

When the piston (22) is at the bottom dead center as shown in FIG. 4(A), the expansion chamber (52) forms a single expansion chamber inside the piston (22). In this state, the volume of the expansion chamber (52) is the maximum. Then, as the drive shaft (33) rotates clockwise to change the structure in the order of (B), (C) and (D) of FIG. 4, the volume of the expansion chamber (52) decreases so that low-pressure refrigerant is released from the outlet port (4*c*) to the outlet pipe (1*b*) through the low-pressure chamber (4*b*).

As for the expansion chamber (52), when the piston (22) is at the bottom dead center as shown in FIG. 4(A), communication is established between the first path (61) and the second path (62) while the inlet pipe (1*a*) communicates with the second path (62), whereby the suction process is started. Thereafter, as the drive shaft (33) rotates clockwise, the first path (61) communicates with the expansion chamber (52) so that the high-pressure liquid refrigerant flows into the expansion chamber (52). Then, when the drive shaft (33) rotates 90° to form the structure of FIG. 4(B), the communication between the first path (61) and the second path (62) is interrupted. Thereafter, as the drive shaft (33) rotates to change the structure as shown in FIG. 4(C) and then FIG. 4(D), the volume of the expansion chamber (52) increases so that the high-pressure refrigerant expands, whereby the structure is returned to the state of FIG. 4(A). The pressure and expansion work of the high-pressure refrigerant are recovered for the rotation of the drive shaft (33).

As described above, the refrigerant is compressed in the compression chamber (51), and heat is released in the exterior heat exchanger (101). Meanwhile, the high-pressure refrigerant from the exterior heat exchanger (101) expands in the expansion chamber (52), heat is absorbed in the interior heat exchanger (102), and the low-pressure refrigerant returns to the compression chamber (51).

—Effects of Embodiment—

As described above, according to this embodiment, the compression chamber (51) and the expansion chamber (52) are formed outside and inside the piston (22), respectively. Therefore, the overall size of the device is decreased.

Since the compression chamber (51) and the expansion chamber (52) are located adjacent to each other on the same plane, some components can be shared therebetween, resulting in a decrease in the number of components.

Since introduction of the refrigerant into the expansion chamber (52) is limited only to a predetermined rotation angle, even expansion work can also be recovered. Therefore, the efficiency is further improved.

Since the compression chamber (51) is formed outside the cylinder chamber (50) and the expansion chamber (52) is formed inside the cylinder chamber (50), the compression capacity is fully utilized.

Since the rotation of the electric motor (30) is controlled by the controller (70), the operation efficiency is further improved.

The swing bush (27) is provided as a coupling member for coupling the piston (22) and the blade (23) and is configured to be substantially in surface contact with the piston (22) and the blade (23). This arrangement avoids the wearing-away of the piston (22) and the blade (23) and the burning of the contact portions therebetween during operation.

Since the swing bush (27) is provided to be in surface contact with the piston (22) and the blade (23), the contact portions achieves excellent sealing characteristics. Therefore, leakage of a refrigerant from the compression chamber (51) and the expansion chamber (52) is surely prevented, and decreases in the compression efficiency and expansion efficiency are also prevented.

Since the blade (23) is integrally provided to the cylinder (21) and supported at both ends by the cylinder (21), it is less likely to apply an abnormal concentrated load to the blade (23) and cause stress concentration during operation. Thus, the slidable portion is more resistant to damage. This feature also improves the reliability of the mechanism.

OTHER EMBODIMENTS

According to the present invention, the above-described embodiment may be modified to have the following alternative structures.

For example, the cylinder (21) may be fixed while the piston (22) may be movable.

The cylinder (21) may be integrated by coupling the outer cylinder (24) and the inner cylinder (25) at their upper ends by the end plate (26), and the piston (22) may be formed integrally with the lower housing (17).

The piston (22) may be formed in the form of a complete ring from which no part is removed, while the blade (23) may be divided into an outer blade (23) and an inner blade (23), such that the outer blade (23) advances from an outer cylinder (21) to make contact with the piston (22), and the inner blade (23) advances from an inner cylinder (21) to make contact with the piston (22).

The refrigerant circuit (100) may only perform heating operation or may be switched between cooling and heating operations.

Furthermore, the refrigerant of the refrigerant circuit (100) is not limited to $CO_2$.

INDUSTRIAL APPLICABILITY

As described above, the present invention is useful for a rotary fluid device having a compression chamber and an expansion chamber and especially suitable for a rotary fluid device having a compression chamber and an expansion chamber on the same plane.

What is claimed is:

1. A rotary fluid device comprising:

a rotation mechanism including a cylinder having an annular cylinder chamber and an annular piston disposed in the cylinder chamber to be eccentric relative to the cylinder, the annular piston dividing the cylinder chamber into an outer working chamber and an inner working chamber, and the piston being C-shaped to form a gap and having a swing bushing therein;

a blade disposed in the cylinder chamber to divide each of the inner and outer working chambers into a high-pressure space and a low-pressure space, the cylinder and the piston being relatively movable by rotation of a driving shaft, the blade extending between an inner peripheral wall surface and an outer peripheral wall surface of the cylinder chamber through the gap of the piston, and the swing bushing being in contact with the piston and the blade such that the blade is reciprocatable and the blade is swingable relative to the piston; and a suction mechanism configured to introduce refrigerant into the annular cylinder chamber, one of the inner and outer working chambers being a compression chamber which compresses and discharges fluid with a progression of a relative movement between the cylinder and the piston, the compression chamber being in fluid communication with a suction pipe arranged to supply the compression chamber with fluid and a discharge pipe arranged to receive compressed fluid from the compression chamber;

the other of the inner and outer working chambers being an expansion chamber which expands and discharges fluid with a progression of a relative movement between the cylinder and the piston with expansion work of the expansion chamber being recovered to assist in driving the driving shaft, the expansion chamber being in fluid communication with an inlet pipe arranged to supply the expansion chamber with fluid and an outlet pipe arranged to discharge expanded fluid from the expansion chamber;

the suction mechanism being configured to introduce refrigerant into the expansion chamber from the inlet pipe in a predetermined rotation angle range of the piston such that a refrigerant expansion process in the expansion chamber occurs in a predetermined range within each rotation cycle of the piston relative to the cylinder, and the suction mechanism including a first path and a second path, the first path having one end communicating with an inlet port that is open to the expansion chamber and an other end having an opening in a vicinity of the inlet pipe, the second path having an arc shape that is curved around a shaft center of the drive shaft and communicating between the inlet pipe and the other end of the first path to cause the refrigerant to flow into the expansion chamber at a predetermined rotation angle range of the piston.

2. The rotary fluid device of claim 1, wherein the compression chamber is a working chamber formed at an outer side of the cylinder chamber, and the expansion chamber is a working chamber formed at an inner side of the cylinder chamber.

3. The rotary fluid device of claim 1, further comprising a drive mechanism for driving the rotation mechanism, with a rotation speed of the drive mechanism being variably controlled.

* * * * *